US005334573A

United States Patent [19]

Schild

[11] Patent Number: 5,334,573

[45] Date of Patent: Aug. 2, 1994

[54] SHEET MATERIAL FOR THERMAL TRANSFER IMAGING

[75] Inventor: Howard G. Schild, Brighton, Mass.

[73] Assignee: Polaroid Corporation, Cambridge, Mass.

[21] Appl. No.: 801,460

[22] Filed: Dec. 2, 1991

[51] Int. Cl.[5] ..... B41M 5/035; B41M 5/38

[52] U.S. Cl. ..... 503/227; 428/195; 428/419; 428/480; 428/500; 428/913; 428/914

[58] Field of Search ..... 8/471; 428/195, 913, 428/914, 419, 480, 500; 503/227

[56] References Cited

U.S. PATENT DOCUMENTS

| | | | |
|---|---|---|---|
| 4,555,427 | 11/1985 | Kawasaki et al. | 428/195 |
| 4,615,938 | 10/1986 | Hotta et al. | 428/323 |
| 4,626,256 | 12/1986 | Kawasaki et al. | 8/471 |
| 4,721,703 | 1/1988 | Kabayashi et al. | 503/227 |
| 4,820,687 | 4/1989 | Kawasaki et al. | 503/227 |
| 4,914,078 | 4/1990 | Hann et al. | 503/227 |
| 4,997,807 | 3/1991 | Mukoyoshi et al. | 503/227 |
| 5,024,989 | 6/1991 | Chiang et al. | 503/227 |

FOREIGN PATENT DOCUMENTS

| | | | |
|---|---|---|---|
| 407615A1 | 1/1991 | European Pat. Off. | 503/227 |
| 0223862 | 11/1985 | Japan | 503/227 |
| 0223878 | 11/1985 | Japan | 503/227 |
| 63-247397 | 6/1990 | Japan | 503/227 |

OTHER PUBLICATIONS

Patent Abstracts of Japan, vol. 14, No. 351.

*Primary Examiner*—B. Hamilton Hess

*Attorney, Agent, or Firm*—Carol A. Loeschorn; Edward W. Black

[57] ABSTRACT

Sheet materials for use in thermal transfer imaging systems comprising a donor sheet and a receiving sheet are provided wherein the donor sheet and the receiving sheet do not stick to each other during thermal processing.

36 Claims, No Drawings

SHEET MATERIAL FOR THERMAL TRANSFER IMAGING

BACKGROUND OF THE INVENTION

1. Field of the Invention

This invention relates to a sheet material for use in a thermal transfer imaging system comprising a receiving sheet and a donor sheet. More particularly, it relates to a thermal imaging system wherein the donor sheet and receiving sheet do not stick to each other during thermal processing.

2. Description of the Related Art

Thermal transfer imaging processes wherein one or more thermally transferable dyes are transferred from a donor sheet to a receiving sheet in response to heat are well known. Such imaging processes employ imaging media consisting of a donor sheet comprising a dye or dyes and a binder for the dyes which is placed adjacent to a receiving sheet suitable for receiving the transferred dye(s). The imaging process comprises heating selected portions of the donor sheet in accordance with image information to effect an imagewise transfer of the dye(s) to the receiving sheet, thereby forming an image on the receiving sheet.

To enhance the image-receiving capability of the image-receiving sheet and thereby obtain higher density images, resins having a low glass transition point and softening point, e.g., polyester resins, are generally coated on the image-receiving sheet. However, when imaging is effected, heat is applied at high temperatures e.g., generally 200° C. or higher when a thermal printhead is employed. The high temperatures cause softening and/or melting of the resin in the image-receiving sheet and the binder for the dyes in the dye donor sheet resulting in adhesion between the two sheets. This adhesion results in sticking and subsequent tearing of the two sheets upon separation from each other.

To eliminate this thermal sticking, it has been suggested to incorporate a dye-permeable release agent in either the donor or receiving sheet which allows for dye transfer but prevents adhesion of the donor sheet to the receiving sheet during printing. The release agent can be employed either as a discrete layer on top of the receiving material or the dye layer in the donor sheet, or the release agent can be blended in with the receiving material before coating.

Materials previously employed as release agents include silicone-based oils, poly(organosiloxanes), fluorine-based polymers, fluorine- or phosphate-containing surfactants, fatty acid surfactants and waxes. The inherently different chemical structure of the release agents from that of the dyes to be transferred leads to an interfacial barrier at the donor/receiver interface causing decreased dye densities in the image-receiving sheet. These materials are surface-active which promotes their presence at the receiving sheet/donor sheet interface where they additionally contribute desired slip properties and frictional characteristics to the image-receiving surface to prevent sticking. However, these release agents tend to be migratory and can be rubbed off the surface by touch, providing areas where sticking can occur. They also attract dirt and dust which degrade image quality.

Crosslinking of various release materials has been proposed to hold the release material in place and to alleviate some of the above problems. U.S. Pat. No. 4,626,256 issued Dec. 2, 1986, U.S. Pat. No. 4,820,687 issued Apr. 11, 1989, and U.S. Pat. No. 4,914,078 issued Apr. 3, 1990 disclose image-receiving layers containing dye-permeable releasing agents comprising hardened type (crosslinked) silicone oils. However, there are disadvantages to having a separate crosslinked material. Not only is there a decrease in dye density due to the inherently different chemical structure of the silicone oils from that of the dyes, but crosslinking additionally causes a decrease in the transferred dye density. The temperature requirements of thermally induced crosslinking processes limit the types of support materials that may be utilized for the receiving sheet. Moreover, certain release materials, most notably the silicone oils and crosslinked silicone oils, make it difficult to laminate the image-receiving sheet to other materials because they inhibit the laminating adhesive from adhering to the image-receiving sheet. Further, the release materials make it difficult to write on the image-receiving sheet because they interfere with ink adhesion at the image-receiving surface.

It has also been suggested to increase the heat resistance of the image-receiving material to prevent softening of the receiving material and hence alleviate sticking. U.S. Pat. No. 4,721,703, issued Jan. 26, 1988, discloses a receiving sheet comprising a base material and a coating composition, the coating composition consisting essentially of a thermoplastic resin for receiving a dye and a compound having two or more free radical polymerizable ethylenically unsaturated double bonds in one molecule, the coating being crosslinked. The resulting receiving sheet is described as being substantially non-heat bondable (does not stick) to the dye layer by virtue of the heat resistance imparted by the crosslinked polymer therein. However, this method is disadvantageous in that crosslinked materials generally result in decreased dye densities and require an additional processing step.

U.S. Pat. No. 4,997,807, issued Mar. 5, 1991, discloses a receiving sheet which is described as free from blocking (sticking of the receiving sheet to the donor sheet during thermal processing). The receiving sheet comprises a support having thereon an image-receiving layer formed by coating a substantially solvent-free coating composition comprising (A) a macromonomer dyeable with a sublimable dye and containing a radical polymerizable functional group at one terminal of the molecular chain thereof, said macromonomer being solid at room temperature, dissolved in (B) a liquid radiation-curable monomer and/or oligomer on a support and irradiating the coat with radiation. According to the examples given in the patent, excellent blocking results were obtained only when a polyfunctional monomer and a siloxane were present. This suggests that both crosslinking and a surface active agent (release agent) are necessary in order to obtain the best results.

U.S. Pat. No. 4,555,427, issued Nov. 26, 1985, discloses a heat transferable sheet (receiving sheet) comprising a receptive layer which receives a dye transferred from a heat transfer printing sheet upon being heated, the receptive layer comprising first and second regions having the following properties:

(a) The first region is formed from a synthetic resin having a glass transition temperature of from −100° to 20° C., preferably from −50° to 10° C., and having polar groups such as an ester linkage, C—CN linkage and C—Cl linkage.

(b) The second region is formed from a synthetic region having a glass transition temperature of at least 40° C., preferably from 50° to 150° C., and preferably the second region-forming synthetic resin has also a polar group.

(c) Both the first region and the second region are exposed at the surface of the receptive layer, and the first region occupies at least 15%, preferably from 15 to 95% of the surface.

(d) The first region is present in the form of mutually independent islands, the respective longitudinal length of which is from 0.5 to 200 μm, preferably from 10 to 100 μm, and desirably the periphery of the first region is substantially surrounded by the second region.

According to the examples given in the patent, hardened silicone oils were added to enhance the releasability of the heat transfer printing sheet upon being heated.

SUMMARY OF THE INVENTION

The present invention provides a sheet material for use in thermal transfer imaging systems which avoids sticking, i.e., the thermal fusing of the donor sheet and the image-receiving sheet during thermal processing, by employing an image-receiving polymer system which is incompatible/immiscible with the donor polymer system. Since the two polymer systems are incompatible/immiscible at the temperature and time which they are in contact, i.e., during thermal processing, there is no thermal adhesion between the donor sheet and the image-receiving sheet.

Specifically, the present invention provides thermal transfer imaging systems comprising a donor sheet and a receiving sheet, the donor sheet comprising a support, an image-forming material capable of being transferred by heat and a polymer system comprising at least one polymer as a binder for the image-forming material, and the receiving sheet comprising a polymer system comprising at least one polymer capable of receiving said image-forming material from said donor sheet upon application of heat thereto, the polymer system of said receiving sheet being incompatible/immiscible with the polymer system of said donor sheet at the receiving sheet/donor sheet interface so that there is no adhesion between the donor sheet and the receiving sheet during thermal processing, said polymer system of the donor sheet and said polymer system of the receiving sheet being substantially free of a release agent, such as silicone-based oils, poly(organosiloxanes), fluorine-based polymers, fluorine- or phosphate-containing surfactants, fatty acid surfactants and waxes.

The present invention further provides for a method of thermal transfer imaging employing the above described sheet materials.

By avoiding the use of a separate release agent, the present invention provides images of higher dye densities. Since no post-coating crosslinking is necessary, a one-step process produces the image-receiving sheet and dye densities are not compromised. Since no heat, other than moderate drying temperatures is required, thermal distortion of the support material is avoided. Moreover, since the present invention lacks a silicone oil or other low surface energy release agent, lamination of the image-receiving sheet to other materials is easier as is writing with ink on the surface of the image.

DETAILED DESCRIPTION OF THE INVENTION

As noted above, the sheet materials of the present invention are used in thermal transfer imaging systems. The donor sheet comprises a support and an image-forming material capable of being transferred by heat and at least one polymer as a binder for the image-forming material. The image-forming material can be a dye or other image-forming material which transfers by diffusion or sublimation, upon application of heat, to the image receiving sheet to form an image therein. It will be understood that where multicolor images are desired, the donor sheet would comprise additional dyes or other image-forming materials. The image-receiving sheet comprises a polymer system comprising at least one polymer capable of receiving said image-forming material from said donor upon the application of heat thereto, the polymer system of said receiving sheet being incompatible/immiscible with the polymer system of the donor sheet at the receiving sheet/donor sheet interface so as to inhibit thermal adhesion between the donor and receiving sheets during thermal processing. The polymer system employed as binder for the image-forming material and the polymer system of the receiving sheet are substantially free of release agents, such as silicone-based oils, poly(organosiloxanes), fluorine-based polymers, fluorine- or phosphate-containing surfactants, fatty acid surfactants and waxes. "Substantially free of" means that none of these materials are intentionally added to aid release. Selected portions of the donor sheet are heated in accordance with image information so as to transfer dye or other image-forming material from the donor sheet to the receiving sheet to form an image thereon.

The image-receiving polymer system of the present invention may be coated on a support or it may be self-supporting.

The terms incompatible and immiscible are used interchangeably but the latter is the preferred term according to *The Encyclopedia of Polymer Science and Engineering*, John Wiley & Sons, 1988, vol. 12, p. 399.

By definition, two polymers are considered to be immiscible if when they are "in contact" (the geometry of which is very much a function of the method of preparation, e.g., melt-mixing, solution mixing, laminating, etc.) there is no intimate mixing, i.e., there are gross symptoms of macroscopic phase segregation/separation into more than one phase.

In the present invention, the donor and receiving polymer systems are "in contact" during imaging and are immiscible at the temperature and time of contact, the latter being on the order of milliseconds, so that there is no mixing of the two and, therefore, no thermal adhesion of the donor and receiving sheets. Thus, while the image-receiving polymer(s) and the binders in the donor sheet may be softened by the temperatures of thermal processing, they are immiscible and, therefore, they do not adhere to each other.

The donor binder serves to keep the image-forming material dispersed uniformly and to prevent transfer or bleeding of the relatively low molecular weight image-forming material except where the donor sheet is heated during the thermal imaging. A necessary requirement, therefore, is that the binder be able to dissolve and/or disperse the dye. This necessarily excludes silicone-based oils, poly(organosiloxanes), fluorine-based polymers, fluorine- or phosphate-containing surfactants, fatty acid surfactants and waxes since these materials, based on their inherent elemental structure, are not capable of keeping the dye uniformly dispersed. Suitable binders for the image-forming material, provided they are immiscible with the polymer system of the receiving sheet, include cellulose resins, such as, ethylcellulose, hydroxyethylcellulose, ethylhydroxyethylcellulose, hydroxypropylcellulose, cellulose acetate, and cellulose acetate butyrate; vinyl resins, such as, polyvinyl alcohol, polyvinyl pyrrolidone, polyvinyl acetate, vinyl alcohol/vinyl butyral copolymers; polyacrylamide resins, and acrylic acid resins, such as, poly(methyl methacrylate).

Desirably the weight ratio of dye or other image-forming material to binder is in the range of from about 0.3:1 to about 2.55:1, preferably about 0.55:1 to about 1.5:1.

The polymer system of the image-receiving sheet serves to enhance the receipt of dye or other image-forming material in the receiving sheet. Suitable polymer(s) which can be used as the image-receiving material must be able to receive dye (or other image-forming material) in order to maximize dye transfer. The polymer(s) used as the image-receiving material can also serve to provide mechanical strength to the receiving sheet and the finished image produced therefrom. Examples of such materials are extruded polymer films wherein the particular polymer chosen is both capable of receiving the image-forming material and providing the necessary mechanical strength.

Polymers which can be used as the image-receiving material include any of those commonly employed in the art as receiving materials provided they are immiscible with the polymer system of the donor sheet. For example, a polyester, polyacrylate, polycarbonate, poly(4-vinylpyridine), polyvinyl acetate, polystyrene and its copolymers, polyurethane, polyamide, polyvinyl chloride, polyacrylonitrile or a polymeric liquid crystal resin may be used as the image-receiving component. Desirably, the polymer for the image-receiving sheet is a polyester resin, preferably a polyester resin comprising aromatic diacids and aliphatic diols e.g., Vylon® 103, Vylon® 200, and Vylon® MD-1200 (an aqueous polyester), all commercially available from Toyobo Co., Ltd., Tokyo, Japan and Vitel® 2200 and Vitel® 2700 commercially available from Goodyear Tire and Rubber Co., Polyester Division, Apple Grove, W.V. Silicone-based oils, poly(organosiloxanes), fluorine-based polymers, fluorine- or phosphate-containing surfactants, fatty acid surfactants and waxes are not suitable compounds to be used as image-receiving materials since they are not very good at receiving and holding onto dyes.

The thickness of the image-receiving layer will generally be in the range of about 0.5 to 5 microns ($\mu$).

As noted above, the donor binder and receiving polymer(s) must be chosen such that they are immiscible with each other, upon contact and softening at the temperature and time of processing, so that no thermal adhesion of the two sheets will occur during processing. A single polymer as binder for the donor and a single polymer as the image-receiving material for the receiving sheet would be preferable; however, it may be necessary to use polymer blends in the donor and/or receiving sheet in order to optimize performance for a given system. The polymer blend chosen for either the donor or receiving sheet may be a homogeneous or heterogeneous blend.

In determining whether two polymers are immiscible one can look to the relevant art, wherein many studies of polymer-polymer compatibility/miscibility have been reported, to find pairs of polymers reported as immiscible. Alternatively, one may employ one of the several techniques which exist in the art to measure polymer-polymer miscibility. For a review of these various techniques see *The Encyclopedia of Polymer Science and Engineering*, John Wiley & Sons, 1985, vol. 3, pp. 760–765. However, these techniques result in measures of miscibility which are relative rather than absolute and depend upon the method of preparation of the polymer blend. Thus, where a polymer blend is found to be immiscible using one technique, another may indicate miscibility. For example, the degree of transparency of the polymer blend is employed as a measure of immiscibility. If the blend is transparent, it generally indicates the polymers are miscible; if translucent or opaque, it generally implies multiple phases and therefore, immiscibility. However, if the refractive indices of the two polymers are close or equal to each other or if the domains in a multiphase blend are smaller than the wavelength of light, the polymer blend may appear transparent even if the two polymers are immiscible.

In addition, miscibility between two polymers is affected by the presence of other substances and, therefore, the dye or other image-forming material in the donor sheet affects the interactions of the donor binder with the receiving-polymer and can influence miscibility. Additionally, the method of coating or choice of solvent from which to coat the polymer blend can impact miscibility. Thus, while determining immiscibility of the donor binder and receiving polymer by one of the available techniques or by locating a pair of polymers found to be immiscible in the literature does not insure that they will work for purposes of the present invention, it is a good starting point. Routine testing under the conditions of the present invention will readily determine if a preliminary finding of immiscibility is maintained under processing conditions.

When a support is employed in the image-receiving sheet, it serves to provide mechanical strength to the receiving sheet and the finished image. The support is not particularly limited, although preferably it should have a thickness of at least 100 microns ($\mu$) and desirably 125 to 225 $\mu$. If the support is of a thickness less than 100 $\mu$, it is susceptible to thermal deformation during printing. The support may be a sheet or film and may be transparent or reflective. Examples of transparent supports include polyesters, polycarbonates, polystyrenes, cellulose esters, polyolefins, polysulfones, polyimides and polyethylene terephthalate. Reflective supports useful for the image-receiving sheet include cellulose paper, polyester coated cellulose paper, polymer coated cellulose paper, e.g., polyethylene or polypropylene coated paper, coated or uncoated wood-free paper, synthetic paper, and plastic films which carry a layer of reflective pigment or which include a filler, e.g., polyethylene terephthalate containing calcium carbonate or titanium dioxide. Also useful is a polyester film made opaque by the presence of voids, commercially available under the tradename "Melinex" from Imperial Chemical Industries (ICI) Films, England.

To avoid peeling or other damage to the image-receiving layer and/or the finished image due to poor adhesion of the image-receiving material to the support, a subcoat may be added to the face of the support which carries the image-receiving material to enhance adhesion. For example, an anionic aliphatic polyester urethane polymer, applied as a subcoat, has been found to enhance adhesion to polyethylene cladded support materials.

The donor sheets used in the present invention can be those conventionally used in thermal dye diffusion transfer imaging systems. In systems of this type the image-forming material in the donor sheet is a dye. The dyes that can be used in the present process can be any of those used in prior art thermal diffusion or sublimation transfer processes. Typically, such a dye is a heat-sublimable dye having a molecular weight of the order of about 150 to 800, preferably 350 to 700. In choosing a specific dye for a particular application, it may be necessary to take account of factors such as heat sublimation temperature, chromaticity, compatibility with any binder used in the donor sheet and compatibility with any image receiving materials on the receiving sheet. Specific dyes previously found to be useful include:

Color Index (C.I.) Yellows Nos. 3, 7, 23, 51, 54, 60 and 79;

C.I. Disperse Blues Nos. 14, 19, 24, 26, 56, 72, 87, 154, 165, 287, 301, and 334;

C.I. Disperse Reds Nos. 1, 59, 60, 73, 135, 146 and 167;

C.I. Disperse Violets Nos. 4, 13, 31, 36 and 56;

C.I. Solvent Violet No. 13;

C.I. Solvent Black No. 3;

C.I. Solvent Green No. 3;

C.I. Solvent Yellows Nos. 14, 16, 29 and 56;

C.I. Solvent Blues Nos. 11, 35, 36, 49, 50 63, 97, 70, 105 and 111; and

C.I. Solvent Reds Nos. 18, 19, 23, 24, 25, 81, 135, 143, 146 and 182.

One specific set of dyes which have been found to give good results in a three-color thermal imaging process of the present invention are:

Yellow C.I. Disperse Yellow No. 231, also known as Foron Brilliant Yellow S-6GL;

Cyan C.I. Solvent Blue No. 63, C.I. No. 61520, 1-(3, -methylphenyl)amino-4-methylaminoanthraquinone;

Magenta A [mixture of approximately equal amounts of C.I. Disperse Red No. 60, C.I. No. 60756, 1-amino-2-phenoxy-4-hydroxyanthraquinone, and C.I. Disperse Violet No. 26, C.I. No. 62025, 1,4-diamino-2,3-diphenoxyanthraquinone].

The donor sheets of the present invention may also be those used in thermal transfer systems which utilize in situ dye generation to form images. In systems of this type, the image-forming material in the donor sheet is a material which, upon application of heat, transfers to the receiving sheet. The transferred image-forming component combines with a material already present in the receiving sheet to generate the desired color. Such systems are described, e.g., in U.S. Pat. No. 4,824,822 and U.S. Pat. No. 5,011,811.

The donor sheet used in the present process conveniently comprises a layer of image-forming material disposed on one face of the support, the layer comprising the image-forming material and a binder for the image-forming material. During thermal imaging, the layer of image-forming material on the support faces the receiving sheet. The support may be paper, for example condenser paper, or a plastic film, for example an aromatic polyamide film, a polyester film, a polystyrene film, a polysulfone film, a polyimide film or a polyvinyl film. The thickness of the support is usually in the range of about 2 μ to about 10 μ, although it is desirable to keep the thickness of the support in the range of about 4 to about 7 μ, since a thick support delays heat transfer from the printing head to the dye and may affect the resolution of the image produced. A donor sheet having a 6 μ polyethylene terephthalate support has been found to give good results in the present process.

Desirably, a layer of a lubricating agent is present on the back of the donor sheet remote from the dye layer, the lubricating agent serving to reduce adhesion of a thermal printing head to the donor sheet. Such a layer of lubricating agent (also called "heat-resistant slipping layers"), and methods for its creation on a donor sheet are described in detail in U.S. Pat. No. 4,720,480, issued Jan. 19, 1988, and hence such lubricating agents will not be described in detail herein. A preferred lubricating agent comprises (a) a reaction product between polyvinyl butyral and an isocyanate; (b) an alkali metal salt or an alkaline earth metal salt of a phosphoric acid ester; and (c) a filler. This lubricating agent may also comprise a phosphoric acid ester free of salts.

The filler used in this preferred lubricating agent can be an inorganic or organic filler having heat resistance, for example, clay, talc, a zeolite, an aluminosilicate, calcium carbonate, polytetrafluoroethylene powder, zinc oxide, titanium oxide, magnesium oxide, silica and carbon. Good results have been achieved in the present process using a lubricating layer containing as filler talc particles with an average size of 1 to 5 μ.

Because it is desirable to keep the donor sheet thin, for reasons already discussed above, the thickness of the lubricating layer preferably does not exceed about 5 μ.

The heat required for thermal transfer may be provided by a thermal printhead or by any other suitable means, e.g., by irradiation with a laser beam as known in the art.

The present invention is described in more detail by the following examples.

The sheet materials of each example were thermally processed using a Hitachi VY-200 thermal printer, sold by Hitachi Ltd., Tokyo, Japan, to print a multi-color test pattern.

All optical reflection densities were measured using an X-Rite 338 photographic densitometer.

EXAMPLE 1

This Example illustrates the preparation of a sheet material according to the present invention and its use in thermal imaging. The donor sheet comprised a support layer of polyethylene terephthalate carrying a dye layer comprised of dye dispersed in poly(methyl methacrylate) (PMMA). The donor sheet was in the form of a long roll comprising a plurality of panes, each pane containing a single color dye or dye mixture, with yellow, cyan and magenta panes being repeated cyclically along the film so that each triplet of three panes contained one pane of each color. One triplet of three panes is used for each print. The yellow pane comprised two pyridone dyes. The cyan pane comprised two anthraquinone dyes, and the magenta pane comprised three anthraquinone dyes.

The literature, e.g., Journal of Applied Polymer Science, 41 (11-12) pp. 2691-2704 (1990), has reported that poly(caprolactone) (PCL) is incompatible with PMMA, and therefore, a receiving sheet was prepared with PCL as the dye receiving material. A 10% w/v solution of PCL in chloroform was coated with a Meyer rod (#20) onto a 4 rail (100 μ thick) 6"×6" (15×15 cm) opaque polyester terephthalate support containing voids containing titanium dioxide (commercially available under the trade name Melinex ® 329, from Imperial Chemical Industries (ICI) Films, England), and dried in a ventilation hood at room temperature. The thickness of PCL was approximately 2μ. The coated sheet was cut to size, and the sheet was thermally printed. There was no sticking of the donor and receiving sheets. The measured dye densities are reported in Table I.

TABLE 1

| | DYE DENSITIES | | | |
|---|---|---|---|---|
| | Black | Cyan | Magenta | Yellow |
| Example 1 | 1.00 | 0.95 | 0.78 | 0.43 |

The foregoing data demonstrates that PCL and PMMA maintain their immiscibility under the thermal processing conditions of Example 1 and thus prevent sticking of the donor and receiving sheet during thermal processing. The data in Table 1 show that PCL receives dye.

EXAMPLE 2

A receiving sheet was prepared and processed as in Example 1, except that the polyester resin, Vylon ® 200, replaced the PCL. This system exhibited essentially total sticking of the donor and receiving sheets during thermal processing indicating the combination of PMMA and Vylon ® 200 for the donor and receiving sheet materials were not immiscible.

EXAMPLE 3

PCL was blended with Vylon ® 200, the polyester resin of Example 2. Five-sheet materials were prepared and processed according to Example 1 except that the image-receiving sheets were prepared as follows: varying ratios of a solution of 16.8% (w/v) Vylon ® 200 in methyl ethyl ketone (MEK) and a 10% (w/v) solution of PCL in chloroform were mixed and coated onto a 4 mil Melinex ® 329 support with a #20 Meyer Rod and dried at room temperature in a ventilation hood to yield a thickness of approximately 2 μ. The percentage (w/w) of PCL in each receiving sheet is reported in Table 2 as are the measured reflectance densities for the cyan, magenta and yellow regions and the visible reflection density for the black region of the test pattern. With 9.3% (w/w) PCL in the receiving material, there was significant sticking and consequently the dye densities could not be measured; however, at all other percentages of PCL reported in Table 2, no sticking was observed. To provide a control, the experiment was repeated using an experimental receiving sheet comprising a Melinex ® 329 support and a dye receiving layer comprising a polyester resin for receiving the dye and a thermally cured silicone release material comprising an epoxy-modified silicone oil and amino-modified silicone oil. The reflectance densities-for the control are shown in Table 2. There was no sticking observed for the control.

From the data it can be seen that at 9.3 (w/w) % PCL, there is significant sticking indicating that under those particular conditions, immiscibility between the donor sheet and receiving polymer system is not maintained. However, at higher concentrations of PCL, e.g., sticking was avoided. Further, at PCL concentrations of about 11%, processing led to significantly higher dye densities as compared with the control which utilized a crosslinked silicone release material to prevent sticking.

The data also demonstrate how polymer blends can be utilized in the receiving sheet to improve performance for a given system, i.e., absence of sticking and high transferred dye densities.

TABLE 2

| | DYE DENSITIES | | | |
|---|---|---|---|---|
| | Black | Cyan | Magenta | Yellow |
| 9.3% PCL | Significant Sticking | Significant Sticking | Significant Sticking | Significant Sticking |
| 11.1% PCL | 2.51 | 2.05 | 2.51 | 2.12 |
| 11.5% PCL | 2.41 | 1.95 | 2.37 | 2.04 |
| 12.4% PCL | 2.08 | 1.68 | 2.15 | 1.60 |
| 14.4% PCL | 2.12 | 1.70 | 2.21 | 1.58 |
| Control | 2.36 | 1.69 | 2.10 | 1.53 |

EXAMPLE 4

This Example illustrates two additional sheet materials according to the present invention.

Based on their structural similarity to poly(caprolactone), two additional aliphatic polyesters, poly(2,2-dimethyl-l,3-propylene succinate) (PDPS) and poly-(ethylene adipate) (PEA), were tested for their immiscibility with PMMA, the binder for the donor sheet, in a sheet material according to the present invention.

Two receiving sheets were prepared as in Example 3, except that the receiving material for one was a mixture of PDPS and Vylon ® 200 containing 9.6 wt. % PDPS, and the receiving material for the other employed a mixture of PEA and Vylon ® 200 (16.3 w/w % PEA). The donor sheet was the donor sheet described in Example 1, which uses PMMA as the binder for the dyes. There was no sticking of the donor and receiving sheets with either receiving sheet upon thermal processing. The measured reflectance densities are reported in Table 3.

From the foregoing data, it will be seen that the sheet material prepared according to the present invention did not result in sticking of the donor and receiving sheets during processing and produced images having good reflectance densities.

TABLE 3

| | DYE DENSITIES | | | |
|---|---|---|---|---|
| | Black | Cyan | Magenta | Yellow |
| 9.6 wt. % PDPS/Vylon ® 200 | 2.44 | 2.10 | 2.56 | 2.25 |
| 16.3 wt. % PEA/Vylon ® 200 | 2.44 | 2.02 | 2.50 | 2.26 |

EXAMPLE 5

This Example illustrates the preparation of sheet materials according to the present invention and the use of these sheet materials in thermal imaging. This Example also repeats the experiments using a control which contains a crosslinked silicone release material to prevent sticking.

Two different receiving materials according to the present invention were prepared and coated onto various support materials to yield coated coverages approximately 2 μ in thickness in accordance with Example 1. The two receiving materials were 1) a 10% (w/v) mixture of Vylon ® 200/PEA, (83.6/16.4 w/w %) in MEK and 2) a mixture of Vylon ® 200/PCL (83/17, w/w %) in MEK:methylene chloride ($CH_2Cl_2$), prepared by combining 7.7 g of a 10% (w/v) solution of PCL/$CH_2Cl_2$ with 37.7 g of a 10% (w/v) solution of Vylon® 200/MEK. These receiving materials were each coated (using a #20 Meyer rod) onto separate 4 mil Melinex® 329 supports, 2 mil Toyobo K 1553 synthetic paper (made of polyethylene terephthalate compounded with fillers) available from Toyobo Co., Ltd., Tokyo, Japan, and in the case of Vylon® 200/PEA on an experimental paper comprising pigmented polyethylene terephthalate on a cellulose core. The coated receiving sheets were dried at room temperature. These image-receiving sheets were used in conjunction with the donor sheet of Example 1 and processed. There was no sticking of the donor and receiving sheets for any of the sheet materials during thermal processing. The reflectance densities are shown in Table 4. To provide a control, the experiment was repeated with a different receiving sheet. The receiving material for the control contained a mixture of Vylon® 200 and a release material comprising 2.5 w/w % of epoxy modified/amino modified silicone oils. This mixture was combined with a 50/50 v/v solution of MEK/-toluene to yield a 10% solids solution and was coated with a #20 Meyer rod to yield a thickness of approximately 2 μ onto the above 3 supports, Melinex® 329, Toyobo and the experimental paper. The resulting sheets were heated for 5 minutes at 110° C. to cure the release material. The receiving sheet employing the Toyobo K 1553 support warped during the thermal curing, but it could still be processed; however, the experimental paper support became so distorted during the curing, it could not be put through the printer. The measured reflection densities for the controls are also shown in Table 4.

TABLE 4

| | DYE DENSITIES | | | |
|---|---|---|---|---|
| | Black | Cyan | Magenta | Yellow |
| Vylon ®/PEA: | | | | |
| (Melinex ®) | 2.29 | 1.70 | 2.32 | 2.09 |
| (Toyobo) | 2.06 | 1.60 | 2.21 | 1.85 |
| (Experimental Paper Support) | 2.64 | 1.77 | 2.73 | 2.46 |
| Vylon ®/PCL: | | | | |
| (Melinex ®) | 2.43 | 1.69 | 2.50 | 2.21 |
| (Toyobo) | 2.10 | 1.60 | 2.33 | 1.98 |
| Control: | | | | |
| (Melinex ®) | 2.06 | 1.57 | 2.26 | 1.55 |
| (Toyobo) | 1.88 | 1.54 | 2.17 | 1.64 |
| (Experimental Paper Support*) | — | — | — | — |

*Could not be thermally printed due to warping.

From the foregoing data it can be seen that the process of the present invention produced images having significantly increased reflection density as compared with the control. The experimental data of Example 5 also demonstrate that the support materials which can be used according to the present invention are not as limited as those which can be used where thermal cross-linking of a release material is employed to prevent sticking. The sheet material of the present invention can be dried at low temperatures, room temperature when organic solvents are used, thereby avoiding the warping which can occur to heat-sensitive supports during thermal curing.

EXAMPLE 6

This example illustrates the preparation of a sheet material according to the present invention and its use in thermal imaging.

The donor sheet is a commercially available material sold by Hitachi, Ltd., Tokyo, Japan designated Hitachi Cassette Color Video Printer Paper Ink Set, VY-SX100 A, high density 100 Series.

The donor sheet is believed to comprise a support layer of polyethylene terephthalate 10 μ in thickness. The support layer carries a dye layer which is 4 μ to 5 μ in thickness and comprises dye dispersed in a vinyl alcohol/vinyl butyral copolymer, which softens at 85° C. and serves as a binder for the dye.

The donor sheet is supplied commercially in a cartridge comprising a feed or supply spool and a take-up spool, the two spools having parallel axes and each being disposed within a substantially light-proof, cylindrical, synthetic resin housing. The opposed ends of the two cylindrical housings are interconnected by a pair of parallel rails, leaving between the two housings an open rectangular frame in which a single pane of the donor sheet can be exposed.

In the commercial cartridge, the donor sheet is in the form of a long roll comprising a plurality of panes, each pane containing a single color dye, with yellow, cyan and magenta panes being repeated cyclically along the film so that each triplet of three panes contains one pane of each color. One triplet of three panes is used for each print. The dyes used are believed to be as follows:

Yellow C.I. Disperse Yellow No. 231, also known as Foron Brilliant Yellow S-6GL;

Cyan C.I. Solvent Blue No. 63, C.I. No. 61520, 1-(3'-methylphenyl)amino-4-methylaminoanthraquinone;

Magenta A [mixture of approximately equal amounts of C.I. Disperse Red No. 60, C.I. No. 60756, 1-amino-2-phenoxy-4-hydroxyanthraquinone, and C.I. Disperse Violet No. 26, C.I. No. 62025, 1,4-diamino--2,3-diphenoxyanthraquinone].

The literature, e.g., A. Dondos and E. Pierri, Polymer Bulletin (Berlin) 16(6), pp. 567–569 (1986), has reported the incompatibility of polyvinyl acetate and polystyrene (PS). Based on the similarity in structure between polyvinyl acetate and vinyl alcohol/vinyl butyral copolymer, i.e., both are aliphatic polymers containing polar groups, PS was used as the image-receiving polymer for the receiving sheet.

Thus, a receiving sheet was prepared according to Example 1, except that PS replaced the PCL. The donor and receiving sheet were processed according to Example 1. There was no sticking of the donor and receiving sheets during processing. The measured reflectance densities are reported in Table 5.

TABLE 5

| | DYE DENSITIES | | | |
|---|---|---|---|---|
| | Black | Cyan | Magenta | Yellow |
| Example 6 | 0.87 | 1.14 | 1.03 | 0.45 |

The foregoing data show that the vinyl alcohol/vinyl butyral copolymer and polystyrene maintain their incompatibility under the conditions of the present Example and that polystyrene receives dye.

It should be noted that Vylon® 200 used in Example 2 results in severe sticking when used by itself as the receiving material with the donor of this example.

Example 7

Liquid crystal polymers (LCP) have been disclosed as useful materials for receiving dyes and result in good dye densities, see U.S. Pat. No. 5,024,989, issued Jun. 18, 1991 to the same assignee as the present invention. However, LCPs have been found to cause undesirable sticking when used in conjunction with the donor sheet of Example 6. To prevent sticking and also achieve good dye densities, a receiving sheet was prepared using a blend of polystyrene and a LCP of the formula

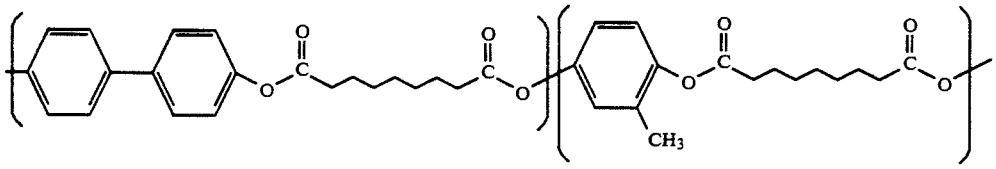

prepared according to the procedure described in the aforementioned U.S. Pat. No. 5,024,989. A 5% w/v solution of LCP in chloroform was combined with a 5% solution of PS in MEK to give a mixture containing 7.75% (w/w) PS/LCP. The resulting mixture was coated with a #20 Meyer Rod to yield a thickness of receiving material ~2 μ after drying. This receiving sheet and the donor sheet as described in Example 6 were thermally imaged. No sticking occurred during processing. The measured reflectance densities are reported in Table 6. To provide a control, the experiment was repeated using the commercial donor sheet described in Example 6 and a commercial receiving sheet, also sold by Hitachi, Ltd., as part of the set for use with the commercial donor. The receiving sheet is separately designated Hitachi Video Print Paper VY-S.

The commercial receiving sheet is believed to comprise a support layer formed of polyethylene terephthalate film 150 μ in thickness and containing pigment particles, which act as an opacifying agent and render the base layer white in color, so that the images produced on the receiving sheet are seen against a white background. One face of the support layer carries a subcoat which is 8 to 10 μ in thickness and, superimposed over this subcoat, an image receiving layer, which is 1.5 to 2 μ in thickness and composed of a polyester resin. Additionally it is believed that the receiving sheet contains a release agent comprised of a crosslinked siloxane material. The subcoat serves to increase the adhesion of the image receiving layer to the underlying support layer. There was no sticking of the donor and receiving sheets during processing. The measured reflectance densities are shown in Table 6.

TABLE 6

| | DYE DENSITIES | | | |
|---|---|---|---|---|
| | Black | Cyan | Magenta | Yellow |
| Example 7 | 1.92 | 1.83 | 2.08 | 1.37 |
| Control | 1.72 | 1.70 | 1.96 | 1.20 |

The foregoing data, particularly the data in Table 6, show that the process of the present invention produced images having significantly increased reflectance density relative to the control.

Since certain changes may be made in the herein described subject matter without departing from the scope of the invention herein involved, it is intended that all matter contained in the above description and Examples be interpreted as illustrative and not in a limiting sense.

I claim:

1. Sheet materials for use in combination in thermal diffusion transfer imaging comprising a donor sheet and a receiving sheet, the donor sheet comprising a support, an image-forming material capable of being transferred by heat and a polymer system comprising at least one polymer as a binder for the image-forming material, and the receiving sheet comprising a polymer system comprising at least one polymer capable of receiving said image-forming material from said donor sheet upon application of heat thereto, the polymer system of said receiving sheet being incompatible/immiscible with the polymer system of said donor sheet at the receiving sheet/donor sheet interface so that there is no adhesion between the donor sheet and the receiving sheet during thermal processing, said donor sheet polymer system and said receiving sheet polymer system being substantially free of a release agent.

2. The combination according to claim 1 wherein said donor sheet polymer system and said receiving sheet polymer system are substantially free of release agents selected from the group consisting of silicone-based oils, poly(organosiloxanes), fluorine-based polymers, fluorine- or phosphate-containing surfactants, fatty acid surfactants and waxes.

3. The combination according to claim 1 wherein said receiving sheet additionally comprises a support material.

4. The combination according to claim 1 wherein said receiving sheet polymer is an extruded polymer film.

5. The combination according to claim 1 wherein said image-forming material is a dye.

6. The combination according to claim 1 wherein the polymer system of said receiving sheet additionally comprises a second polymer forming a polymer blend.

7. The combination according to claim 1 wherein said donor sheet polymer system comprises a blend of two or more polymers as the binder for said image-forming material.

8. The combination according to claim 1 wherein the polymer for said donor sheet is an acrylate resin.

9. The combination according to claim 8 wherein said acrylate resin is poly(methyl methacrylate).

10. The combination according to claim 9 wherein the polymer system for said receiving sheet comprises poly(2,2-dimethyl-1,3-propylene succinate) polyester.

11. The combination according to claim 10 wherein the polymer system for said receiving sheet additionally comprises a second polyester resin comprised of aromatic diacids and an aliphatic diol.

12. The combination according to claim 9 wherein the polymer system for said receiving sheet comprises poly(ethylene adipate) polyester.

13. The combination according to claim 12 wherein the polymer system for said receiving sheet additionally comprises a second polyester resin comprised of aromatic diacids and an aliphatic diol.

14. The combination according to claim 9 wherein the polymer system for said receiving sheet comprises poly(caprolactone) polyester.

15. The combination according to claim 14 wherein the polymer system for said receiving sheet additionally comprises a second polyester resin comprised of aromatic diacids and an aliphatic diol.

16. The combination according to claim 1 wherein the polymer for said donor sheet is a poly(vinyl butyral) resin.

17. The combination according to claim 16 wherein the polymer system for said receiving sheet comprises polystyrene 18. The combination according to claim 17 wherein the polymer system for said receiving sheet additionally comprises a liquid crystal polymer.

19. A process for thermal diffusion transfer imaging comprising placing a donor sheet and an image-receiving sheet adjacent to one another and heating selected portions of the donor sheet so as to transfer said image-forming material from the donor sheet to the receiving sheet, the donor sheet comprising a support, an image-forming material capable of being transferred by heat and a polymer system comprising at least one polymer as a binder for the image-forming material, and the receiving sheet comprising a polymer system comprising at least one polymer capable of receiving said image-forming material from said donor sheet upon application of heat thereto, the polymer system of said receiving sheet being incompatible/immiscible with the polymer system of said donor sheet at the receiving sheet/donor sheet interface so that there is no adhesion between the donor sheet and the receiving sheet during thermal processing, said donor sheet polymer system and said receiving sheet polymer system being substantially free of a release agent.

20. A process for thermal imaging according to claim 19 wherein said donor sheet polymer system and said receiving sheet polymer system are substantially free of release agents selected from the group consisting of silicone-based oils, poly(organosiloxanes), fluorine-based polymers, fluorine- and phosphate-containing surfactants, fatty acid surfactants and waxes.

21. A process for thermal imaging according to claim 19 wherein said receiving sheet additionally comprises a support material.

22. A process for thermal imaging according to claim 19 wherein said receiving sheet polymer is an extruded polymer film.

23. A process for thermal imaging according to claim 19 wherein said image-forming material is a dye.

24. A process for thermal imaging according to claim 19 wherein the polymer system for said receiving sheet additionally comprises a second polymer forming a polymer blend.

25. A process for thermal imaging according to claim 19 wherein said donor sheet polymer system comprises a blend of two or more polymers as the binder for said image-forming material.

26. A process for thermal imaging according to claim 19 wherein the polymer for said donor sheet is an acrylate resin.

27. A process for thermal imaging according to claim 26 wherein said acrylate resin is poly(methyl methacrylate).

28. A process for thermal imaging according to claim 27 wherein the polymer system for said receiving sheet comprises poly(caprolactone) polyester.

29. A process for thermal imaging according to claim 28 wherein the polymer system of said receiving sheet additionally comprises a second polyester resin comprised of aromatic diacids and an aliphatic diol.

30. A process for thermal imaging according to claim 27 wherein the polymer system for said receiving sheet comprises poly(2,2-dimethyl-1,3-propylene succinate) polyester.

31. A process for thermal imaging according to claim 30 wherein the polymer system for said receiving sheet additionally comprises a second polyester resin comprised of aromatic diacids and an aliphatic diol.

32. A process for thermal imaging according to claim 27 wherein the polymer system for said receiving sheet comprises poly(ethylene adipate) polyester.

33. A process for thermal imaging according to claim 32 wherein the polymer system for said receiving sheet additionally comprises a second polyester resin comprised of aromatic diacids and an aliphatic diol.

34. A process for thermal imaging according to claim 19 wherein the polymer for said donor sheet is a poly(vinyl butyral) resin.

35. A process for thermal imaging according to claim 34 wherein the polymer system for said receiving sheet comprises polystyrene.

36. A process for thermal imaging according to claim 35 wherein the polymer system for said receiving sheet additionally comprises a liquid crystal polymer.

* * * * *